US005545052A

United States Patent [19]

Hirai

[11] Patent Number: 5,545,052

[45] Date of Patent: Aug. 13, 1996

[54] ELECTRICAL CONNECTOR

[75] Inventor: Yuji Hirai, Tokyo, Japan

[73] Assignee: Honda Tsushin Kogyo Kabushiki Kaisha, Tokyo, Japan

[21] Appl. No.: 265,842

[22] Filed: Jun. 24, 1994

Related U.S. Application Data

[63] Continuation-in-part of Ser. No. 103,106, Aug. 9, 1993, abandoned.

[30] Foreign Application Priority Data

Aug. 19, 1992 [JP] Japan ..... 4-058160

[51] Int. Cl.$^6$ ..... H01R 13/627

[52] U.S. Cl. ..... 439/354; 439/357; 439/607

[58] Field of Search ..... 439/306, 339, 439/340, 354, 356, 357, 414, 358, 419, 607, 665, 610

[56] References Cited

U.S. PATENT DOCUMENTS 4,900,262 2/1990 Matsuzuaki .
5,021,002 6/1991 Noschese .
5,158,473 10/1992 Takahashi et al. .
5,171,161 12/1992 Kachlic .
5,234,357 8/1993 Yamaguchi ..... 439/354

FOREIGN PATENT DOCUMENTS 3-50624 10/1991 Japan .

*Primary Examiner*—Khiem Nguyen
*Attorney, Agent, or Firm*—Armstrong, Westerman, Hattori, McLeland & Naughton

[57] ABSTRACT

An electrical connector has an electrically insulating member for holding therein a plurality of laterally arranged longitudinally elongated electrical contacts, a metallic shell arranged in a pair of split halves to be fitted together to contain therebetween the electrically insulating member, and a resinous cover to cover the metallic shell. One of the halves of the metallic shell has a pair of resilient means provided on a front end of the metallic shell, each of the resilient members having an outwardly projecting engaging piece which is disposed in such a portion as is outside the resinous cover. The resinous cover has a pair of flexible portions which are so arranged as to urge the resilient means inwards when pressed towards each other, whereby the engaging pieces are also moved towards each other. Each of the resilient means has a projecting piece which extends from a front side wall portion thereof towards the electrically insulating member. The electrically insulating member has a pair of slits for receiving therein the respective projecting pieces of the resilient members.

4 Claims, 4 Drawing Sheets

ELECTRICAL CONNECTOR

This application is a continuation-in-part application of U. S. Ser. No. 08/103,106, filed Aug. 9, 1993, now abandoned.

BACKGROUND OF THE INVENTION

1. Field of the Invention

The present invention relates to an electrical connector which is used in connecting a communication cable to a receiving connector (or a mating electrical connector) which is embedded in a relatively very thin member or a minute piece of equipment such as an IC memory card or the like.

2. Description of Related Art

As disclosed, for example, in Japanese Examined Utility Model Registration Application No. 50624/1991, this kind of electrical connector is constructed to enclose an insulating member by a metallic shell or a shell which is coated with a metallic film in order to shield an electrically conducting member from static electricity or electromagnetic interference waves. It is further provided with a swingable locking claw or engaging piece which is mounted on the insulating member via a supporting shaft for securely engaging or mating it with a mating connector.

The construction as disclosed in the above-described prior art has the following disadvantages. Namely, the insulating member becomes large due to the presence of a portion in which the locking claw is mounted. Further, the electrical connector becomes relatively large due to the presence of constituent parts such as the locking claw, the supporting shaft, or the like and, as a consequence, it becomes difficult to apply it in a minute equipment such as the IC memory card. The cost for manufacturing it also becomes high if it has to be made to suit such a purpose.

SUMMARY OF THE INVENTION

Therefore, it is an object of the present invention to provide an electrical connector in which a shell is formed by using a metallic plate so as to keep the electrical connector small without an increase in the number of constituent parts and in which a locking mechanism can be provided by utilizing the metallic shell.

It is another object to provide an electrical connector in which the connection between constituent members as well as the connection between the connector and a receiving connector or a mating electrical connector can be made in a stable and reliable manner.

According to the present invention, the foregoing and other objects are attained by an electrical connector comprising an electrically insulating member for holding therein a plurality of laterally arranged longitudinally elongated electrical contacts, a metallic shell arranged in a pair of split halves to be fitted together to contain therebetween the electrically insulating member, and a resinous cover to cover the metallic shell. One of the split halves of the metallic shell has a pair of resilient means provided On a front end of the metallic shell, each of the resilient means having an outwardly projecting engaging piece which is disposed in such a portion as is outside the resinous cover. The resinous cover has a pair of flexible portions which are so arranged as to urge the resilient means inwards when pressed towards each other, whereby the engaging pieces are also moved towards each other. Each of the resilient means has a projecting piece which extends from a fixed portion thereof towards the electrically insulating member. The electrically insulating member has a pair of slits for receiving therein the respective projecting pieces of the resilient means.

Preferably, each of the resilient means comprises a movable portion which is bent from the front side wall portion so as to be urged laterally.

Preferably, one of the split halves of the metallic shell having the resilient means are provided with recesses for receiving therein movable portions of the resilient means when the resilient means are pressed towards each other.

Further, preferably the electrically insulating member has a pair of side walls which extend substantially along part of the movable portions of the resilient means.

Since the electrical connector of the present invention has the above-described construction, once the connector is inserted by force into the mating electrical connector, the engaging pieces such as locking claws on the resilient means (FIG. 9) come into engagement with and locked into the receiving means such as receiving holes which are provided in the receiving connector. When the engagement between the electrical connector and the receiving connector is to be released, the flexible portions of the resinous cover are pushed towards each other. As a result, the engaging pieces are released from the receiving means, thereby enabling the two connectors to separate from each other. The outwardly projecting engaging pieces are caused to be moved towards each other sufficient to cause them to be completely out of engagement with unillustrated receiving means of an unillustrated receiving connector. The pair of side walls of the electrically insulating member function to support the side walls of the receiving connector so that the resilient means is not subjected to a pressure or lateral force to be generated between the pair of side walls of the electrically insulating member and the side walls of the receiving connector.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

One embodying example of the present invention will now be explained with reference to the accompanying drawings.

Figure 1:
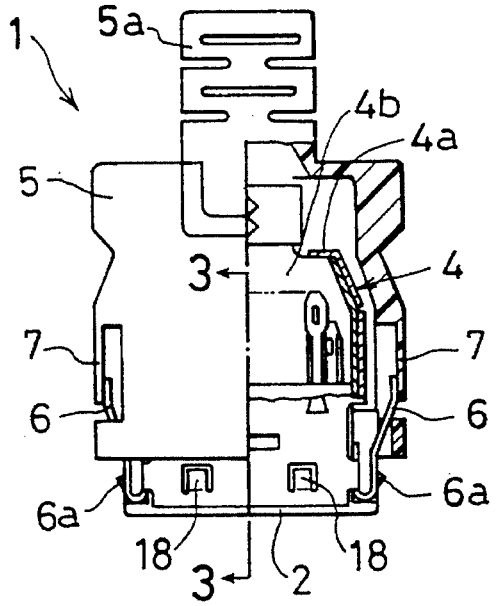
FIG. 1 is a plan view, partly in section, of one example of an electrical connector according to the present invention.
Figure 2:
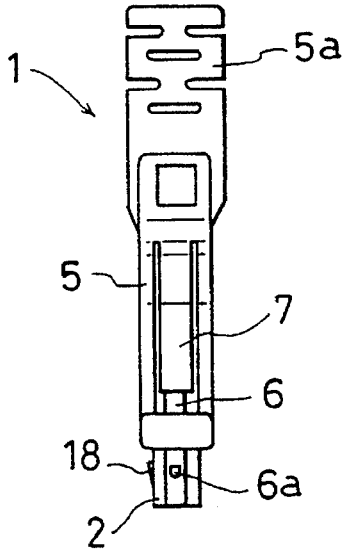
FIG. 2 is a side view thereof.
Figure 3:
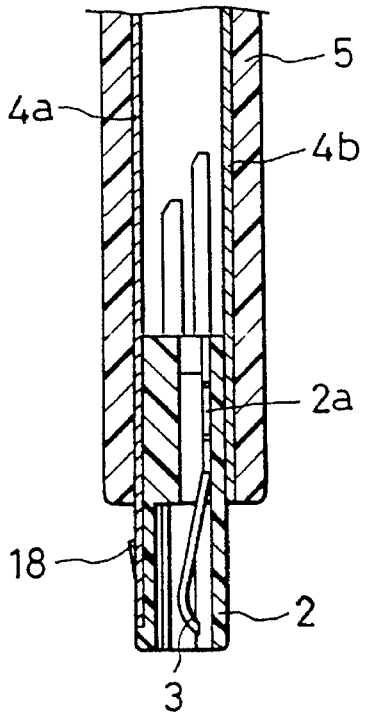
FIG. 3 is a sectional view taken along the line 3—3 in FIG. 1.

In FIGS. 1 through 3, numeral 1 denotes an electrical connector and numeral 2 denotes an electrically insulating member. In laterally arranged inserting holes 2*a* of the electrically insulating member 2 there are inserted a plurality of electrical contacts 3 which extend in a longitudinal direction (i.e., in a direction in which the electrical connector is moved for engagement and disengagement). The electrically insulating member 2 is sequentially covered with a metallic shell 4 (i.e., a shell made of a metallic plate such as a stainless steel plate) and a resinous cover 5 (i.e., a cover made of a synthetic resin). The metallic shell 4 is made up by fitting together a metallic female shell half 4*a* and a metallic male shell half 4*b*. The female shell half 4*a*, which is arranged to receive therein the male shell half 4*b*, is provided with a pair of resilient pieces 6 each having an engaging piece in the form of a locking claw 6*a* such that each resilient piece 6 is bent substantially into a J-shape. One end of each of the J-shaped resilient pieces 6 extends integrally, at right angles, from the female shell half 4*a* (therefore, this end of the resilient piece may also be called a fixed end as opposed to a movable portion, or a front side wall portion as hereinafter described). After turning oppositely near the front end of the electrical connector towards the rear direction (i.e., the direction in which the electrical connector is pulled for disengaging), the other free end of each of the resilient pieces 6 extends further away from each other to allow for sufficient resilient movement thereof in the lateral direction (therefore, this portion is called a movable portion).

A cover 5 is arranged to enclose or cover part of the metallic shell 4 and is provided, in a projecting manner on its rear end, with a flexible member 5*a* for inserting or embedding therein an electrical cord or cable. On each lateral side of the cover 5 there is provided a flexible portion 7 which is formed in the form of a thin tongue-like piece to cover the free end of the resilient piece 6.

Figure 4:
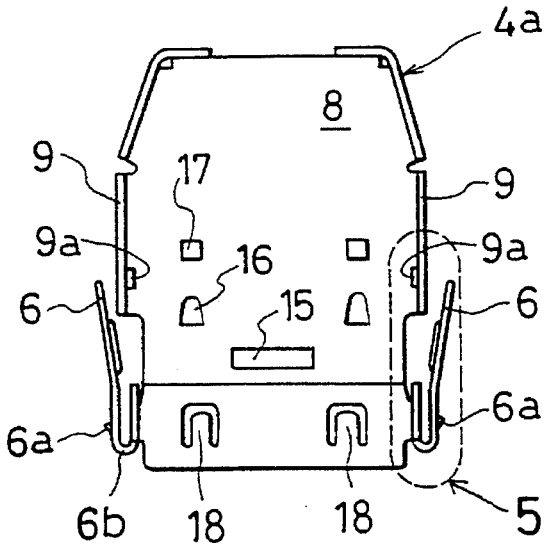
FIG. 4 is a plan view of a female shell half.
Figure 5:
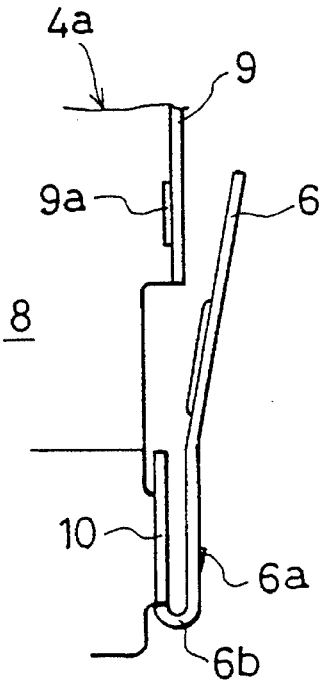
FIG. 5 is an enlarged view of an encircled portion 5 in FIG. 4.
Figure 6:
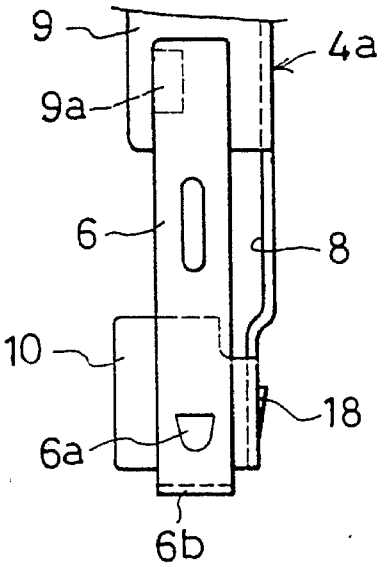
FIG. 6 is a side view thereof.

The above-described female shell half 4*a* is provided, as shown in FIG. 4, with side walls 9 which are formed by bending, at right angles, part of the female shell half 4*a* to extend from a base portion 8 thereof. As shown in FIGS. 5 and 6, a side wall 10 on a front side of the female shell half 4*a* (called a front side wall portion) is formed to extend by bending, at right angles, each side of the base portion 8 thereof. From each of these side walls 10 there integrally extends the resilient piece 6 is described above. An inwardly and downwardly erected or projecting portion 9*a* is provided on each of the side walls 9.

Figure 7:
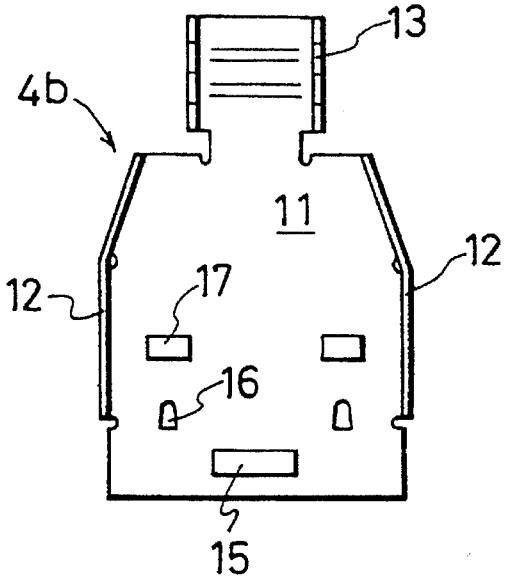
FIG. 7 is a plan view of a male shell half.
Figure 8:
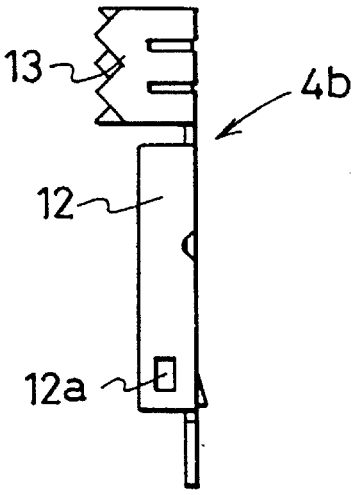
FIG. 8 is a side view thereof.

As shown in FIGS. 7 and 8, the male shell half 4*b* is provided with side walls 12 which are formed by bending, at right angles, part of the male shell half 4*b* to extend from a base portion 11 thereof, as well as a portion 13 for fixing the electric cord or cable. Square holes 12*a* are formed in the side walls 12. When the side walls 9, 12 of the female and the male shell halves 4*a*, 4*b* are fitted together with the electrically insulating member 2 in between, the above-described projecting portions 9*a* come into engagement with the square holes 12*a*, thereby preventing the shell halves 4*a*, 4*b* from being separated.

Figure 9:
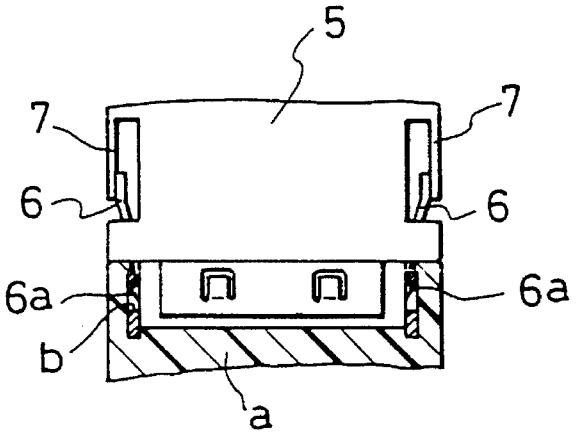
FIG. 9 is a side view, partly in section, explaining the operation or function of locking claws.
Figure 10:
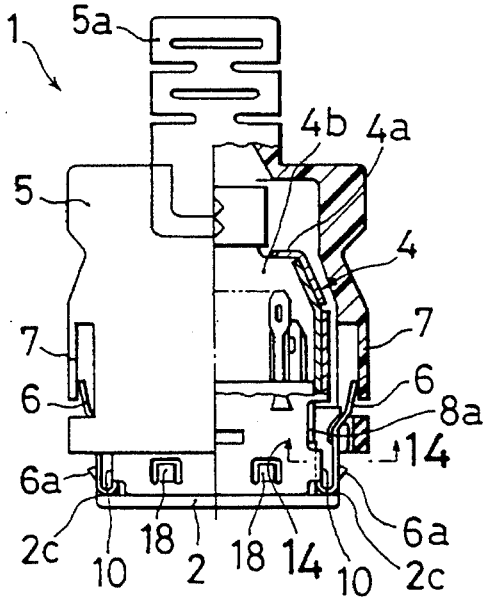
FIG. 10 iS a plan view, partly in section, of another embodying example of the present invention.
Figure 11:
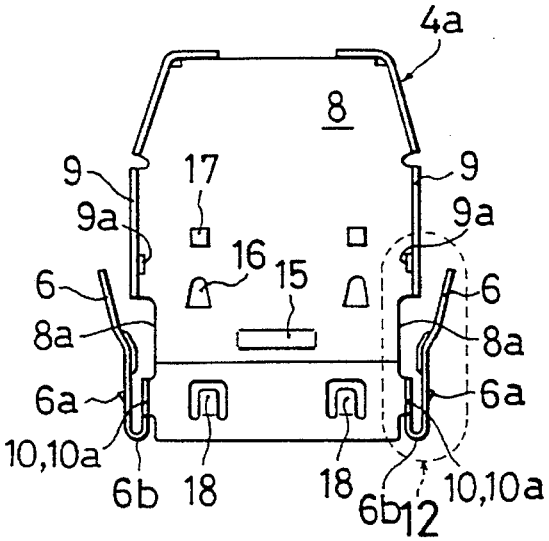
FIG. 11 is a plan view of a female shell half thereof.
Figure 12:
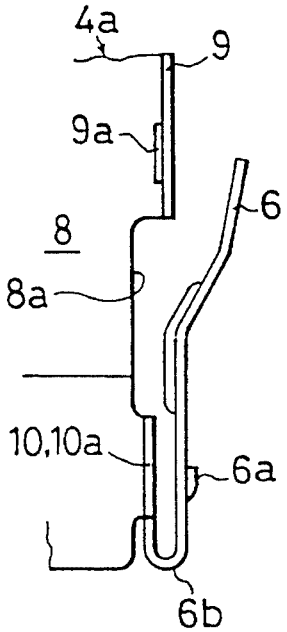
FIG. 12 is an enlarged view of a portion 12 encircled in FIG. 11.

In FIGS. 4 and 7, numerals 15 and 16 denote inward projections to engage with dents (not shown) in the electrically insulating member 2 and numeral 17 denotes outward projections to engage with dents (not shown) in the cover 5. Tongue-like springs 18 in FIGS. 1 through 3 function to be elastically urged against the internal surface of a mating electrical connector, thereby preventing clattering of a connected electrical connector assembly. As shown in FIG. 9, the locking claws 6*a* are engaged with the receiving means in the form of receiving holes b which are provided in an electrically insulating member "a" in a receiving connector, thereby bringing the two electrical connectors into secure engagement. When the two electrical connectors are to be disengaged, the resilient pieces 6 are urged towards each other via the flexible portions 7 to move the locking claws 6*a* inwards, thereby releasing the engagement of the locking claws 6*a* out of the receiving holes b.

FIGS. 10 through 15 show another embodying example of the present invention. Those elements and portions which are substantially the same as those shown in FIGS. 1 through 9 are given the same reference numerals and their explanations are not always repeated here.

Figure 13:
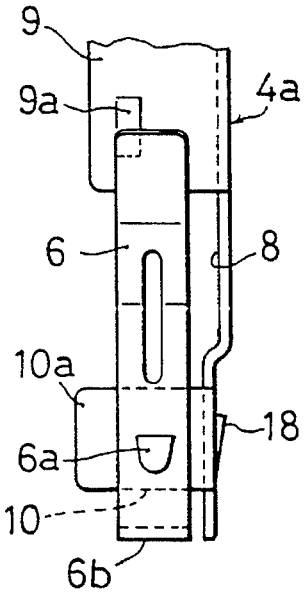
FIG. 13 is a side view thereof.
Figure 15:
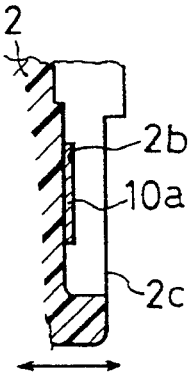
FIG. 15 is a sectional view taken along the line 15—15 in FIG. 14.

The resilient pieces 6, 6 are formed in substantially the same way as above. However, as shown in FIG. 13, the longitudinal length of each of the side walls 10, 10 is made shorter by curtailing or cutting the end on the side facing the other side wall 9. Further, each of the side walls 10, 10 extends in the direction away from the base portion 8 of the metallic shell 4 (i.e., towards the electrically insulating member 2) beyond the width of the resilient piece 6 so as to form a projecting piece 10a on top of the side wall 10. The electrically insulating member 2 has, as shown in FIG. 15, a pair of slit 2*b* which are so formed as to receive the projecting pieces 10*a*, 10*a* into close engagement with each other when the two members (i.e., the electrically insulating member 2 and the female shell half 4*a*) are fitted together. By this engagement of the projecting pieces 10*a*, 10*a* with the slits 2*b*, 2*b*, the electrically insulating member 2 can be held inside the metallic shell 4 without Giving rise to lateral or longitudinal movement.

Further, the base portion 8 of the female shell half 4*a* is provided with a pair of recesses 8*a*, 8*a* which are formed on both sides thereof close to the movable portions of the resilient means 6, 6. These recesses 8*a*, 8*a* are formed by cutting the base portion 8 inwards. In addition, by the presence of each of these recesses 8*a*, 8*a*, two pieces of side walls 9, 10 are also formed in a curtailed discontinuous manner. It follows that there is a space in these recesses 8*a*, 8*a* towards or into which the movable portions of the resilient pieces 6, 6 can be bent when they are pressed towards each other.

Figure 14:
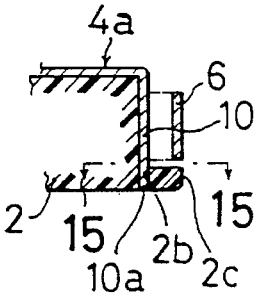
FIG. 14 is a sectional view taken along the line 14—14 in FIG. 10.

Further, as shown in FIGS. 14 and 15, the electrically insulating member 2 is provided with a side wall 2*c* on each side thereof such that it abuts the inner wall of the unillustrated receiving connector when it is fitted thereinto. These side walls 2*c*, 2*c* thus function in the following manner. Namely, when the connector 1 receives an external force in the lateral direction while it is inserted into the receiving connector, these side walls 2*c*, 2*c* prevent the connector 1 from moving sidewise. In this manner, the locking claws 6*a*, 6*a* of the resilient pieces 6, 6 are prevented from being inadvertently released out of engagement with the receiving holes b, b of the receiving connector (FIG. 9) through the lateral movement of the connector 1 as shown by an arrow in FIG. 15.

As has been explained hereinabove, since the shell is made by forming a metallic plate into a pair of split halves, the electrical connector of the present invention can be made thin and small. Further, since the engaging pieces to be engaged with the receiving connector are formed on resilient means which extend from the metallic shell, the electrical connector can be made in a compact manner without increasing the number of constituent parts, resulting in a small and inexpensive electrical connector.

By employing the construction of engaging the projecting pieces provided on the side of the front side wall portion of the resilient means with the slits provided in the electrically insulating member, the relative positional relationship of the related parts can be made more accurate.

Further, by providing the side walls in the electrically insulating member in a manner as set forth, the resilient pieces are prevented from being pushed inwards by the swinging movement of the receiving connector, thus minimizing the possibility of the receiving connector's being inadvertently pulled out of engagement with the electrical connector.

It is readily apparent that the above-described electrical connector meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. An electrical connector comprising:

an electrically insulating member for holding therein a plurality of laterally arranged longitudinally elongated electrical contacts;

a metallic shell arranged in a pair of split halves to be fitted together to contain therebetween said electrically insulating member; and a resinous cover to cover said metallic shell;

one of said split halves of said metallic shell having a pair of resilient means provided on a front end of said metallic shell, each of said resilient means having an outwardly projecting engaging piece which is disposed in such a portion as is outside said resinous cover;

wherein said resinous cover has a pair of flexible portions which are so arranged as to urge said resilient means inwards when pressed towards each other, whereby said engaging pieces are also moved towards each other;

wherein proximate each of said resilient means said one of said split halves has a projecting piece which extends from a front side wall portion thereof towards said electrically insulating member;

wherein said electrically insulating member has a pair of slits for receiving therein said respective projecting pieces of said resilient means; and wherein each said front side wall portion extends in the direction away from a base of said one of said split halves, said resilient means each comprises a J-shaped piece extending from a front of the respective front side wall portion and turning oppositely toward the rear direction, and said projecting piece proximate each said resilient means comprises said front side wall portions extending beyond the width of the resilient means so as to form said protecting piece on top of the front side wall portions.

2. An electrical connector according to claim 1, wherein each of said resilient means comprises a movable portion which is bent from said front side wall portion so as to be urged laterally.

3. An electrical connector comprising:

an electrically insulating member for holding therein a plurality of laterally arranged longitudinally elongated electrical contacts;

a metallic shell arranged in a pair of split halves to be fitted together to contain therebetween said electrically insulating member; and a resinous cover to cover said metallic shell;

one of said split halves of said metallic shell having a pair of resilient means provided on a front end of said metallic shell, each of said resilient means having an outwardly projecting engaging piece which is disposed in such a portion as is outside said resinous cover;

wherein said resinous cover has a pair of flexible portions which are so arranged as to urge said resilient means inwards when pressed towards each other, whereby said engaging pieces are also moved towards each other;

wherein proximate each of said resilient means said one of said split halves has a protecting piece which extends from a front side wall portion thereof towards said electrically insulating member;

wherein said electrically insulating member has a pair of slits for receiving therein said respective projecting pieces of said resilient means;

wherein each of said resilient means comprises a movable portion which is bent from said front side wall portion so as to be urged laterally; and wherein said one of said split halves of said metallic shell having said resilient means are provided with recesses for receiving therein said movable portions of said resilient means when said resilient means are pressed towards each other.

4. An electrical connector according to any one of claims 1 through 3, wherein said electrically insulating member has a pair of side walls which extend substantially along part of said movable portions of said resilient means.

* * * * *

UNITED STATES PATENT AND TRADEMARK OFFICE

CERTIFICATE OF CORRECTION

PATENT NO.: 5,545,052
DATED : August 13, 1996
INVENTOR(S): HIRAI

It is certified that error appears in the above-identified patent and that said Letters Patent is hereby corrected as shown below:

In claim 3, column 6, line 36, "protecting" should read --projecting--.

Signed and Sealed this

Seventeenth Day of December, 1996

*Attest:*

*Attesting Officer*

BRUCE LEHMAN

*Commissioner of Patents and Trademarks*